US011421893B2

(12) United States Patent
Wild

(10) Patent No.: US 11,421,893 B2
(45) Date of Patent: Aug. 23, 2022

(54) COOKING APPLIANCE, IN PARTICULAR COMMERCIAL COOKING APPLIANCE

(71) Applicant: Convotherm-Elektrogeräte GmbH, Eglfing (DE)

(72) Inventor: Hannes Wild, Riegsee (DE)

(73) Assignee: WELBILT DEUTSCHLAND GMBH, Herborn (DE)

( * ) Notice: Subject to any disclaimer, the term of this patent is extended or adjusted under 35 U.S.C. 154(b) by 65 days.

(21) Appl. No.: 16/108,829

(22) Filed: Aug. 22, 2018

(65) Prior Publication Data

US 2019/0063758 A1 Feb. 28, 2019

(30) Foreign Application Priority Data

Aug. 23, 2017 (DE) ..... 102017214762.8

(51) Int. Cl.
*F24C 15/32* (2006.01)
*F24C 15/00* (2006.01)

(52) U.S. Cl.
CPC ..... *F24C 15/327* (2013.01); *F24C 15/003* (2013.01)

(58) Field of Classification Search
CPC .... A47J 2027/043; A47J 27/04; F24C 15/327
See application file for complete search history.

(56) References Cited

U.S. PATENT DOCUMENTS 4,447,917 A * 5/1984 Walter ..... E03C 1/306 134/167 C
4,509,412 A * 4/1985 Whittenburg ..... A47J 27/04 126/20
7,049,551 B2 * 5/2006 Williams ..... A21B 3/04 126/20
7,853,130 B2 * 12/2010 Frock ..... A47J 27/04 392/441
8,997,730 B2 4/2015 Kulakowski et al.
9,775,459 B2 * 10/2017 Wurdinger ..... F24C 15/2007
10,357,126 B2 * 7/2019 Frock ..... A47L 15/14
10,531,760 B2 * 1/2020 Wild ..... B01D 17/0214
10,973,360 B2 * 4/2021 Frock ..... F22B 37/486
2006/0081592 A1 * 4/2006 Williams ..... F24C 7/087 219/401
2006/0260476 A1 * 11/2006 Helm ..... F24C 14/005 99/476
2008/0029612 A1 * 2/2008 Peckham ..... F24D 1/005 237/19
2013/0133638 A1 5/2013 Kulakowski
2014/0290500 A1 * 10/2014 Wurdinger ..... F24C 15/2007 99/403

(Continued)

FOREIGN PATENT DOCUMENTS

DE 10157808 A1 6/2003
KR 20130029646 A 3/2013

*Primary Examiner* — Avinash A Savani
*Assistant Examiner* — Deepak A Deean
(74) *Attorney, Agent, or Firm* — Ohlandt, Greeley, Ruggiero and Perle, LLP

(57) ABSTRACT

A cooking appliance, in particular a commercial cooking appliance, comprising a housing in which a cooking space is arranged and which is provided with a housing outlet, a condenser connected with the cooking space, a cooling water supply device and an appliance outlet, wherein the condenser has a multi-chamber system and the cooling water supply device comprises at least one supply line leading into the chamber provided with the appliance outlet.

12 Claims, 3 Drawing Sheets

(56) References Cited

U.S. PATENT DOCUMENTS

| | | | | |
|---|---|---|---|---|
| 2014/0291312 | A1* | 10/2014 | Wurdinger | A21B 3/04<br>219/401 |
| 2014/0319119 | A1* | 10/2014 | Raghavan | H05B 1/0263<br>219/396 |
| 2015/0059595 | A1 | 3/2015 | Rand | |
| 2015/0257572 | A1* | 9/2015 | Wurdinger | A23L 5/13<br>426/231 |
| 2016/0157658 | A1 | 6/2016 | Cupp | |
| 2016/0198884 | A1* | 7/2016 | Wild | F24C 15/327<br>426/231 |
| 2016/0198893 | A1* | 7/2016 | Wild | A47J 36/34<br>137/15.16 |
| 2016/0282068 | A1* | 9/2016 | Reckner | A47J 27/04 |

* cited by examiner

COOKING APPLIANCE, IN PARTICULAR COMMERCIAL COOKING APPLIANCE

BACKGROUND

1. Field of the Disclosure

The disclosure relates to a cooking appliance, in particular in form of a commercial cooking appliance.

2. Discussion of the Background Art

Such a cooking appliance is known from DE 41 16 544 C1.

As due to relevant regulations differing from one country to another wastewater is permitted to be discharged into the sewage system only up to certain temperature limits, as for example 65° C., it is required to cool the water bath accumulating in the condenser of the cooking appliance correspondingly. Therefore, the cooking appliance according to the preamble has a water jet pump the conveying pipe of which is merging beneath the water surface of the water bath. Further, in the device according to the preamble cooling air is introduced into the condenser enabling an additional cooling of the water bath in the condenser.

From DE 89 02 903.8 another cooking appliance is known in which cold water is fed into a main pipe, connected with the cooking space, through a water nozzle under high pressure in order to be able to evacuate vapor out of the cooking space and to extinguish it immediately. Then the evacuated and extinguished vapor is discharged through an outlet.

Testing performed in the context of the disclosure has revealed that even though it is possible by these methods to cool the water bath accumulating in the condenser and partially heated to high temperature to such an extent that the set limits will not be exceeded, but therefore in the hitherto known cooking appliances very large quantities of water are fed into for security reasons, significantly increasing the water consumption of hitherto known cooking appliances and accordingly raising the operating costs.

Therefore, it is an object of the present disclosure to provide a cooking appliance which, on one hand, ensures that limits for wastewater permitted to be discharged into sewage systems will not be exceeded, but on the other hand enables to reduce the water consumption.

SUMMARY

Firstly, the cooking appliance according to the disclosure is characterized by a condenser with a multi-chamber system comprising a first, a second and a third chamber in a particularly preferred embodiment. Herein, the first chamber is fluidly connected with the cooking space through a housing outlet and provided with a first water trap.

The second chamber follows the first chamber, is fluidly connected therewith and has a second water trap. The third chamber in turn follows the second chamber and is also fluidly connected therewith, has a third water trap and is connected with an appliance outlet protruding into the third chamber up to the level of the third water trap. The appliance outlet leads to the sewage system into which the wastewater of the cooking appliance has to be discharged, wherein certain temperature limits must not be exceeded, as explained at the beginning.

In order to ensure this, the supply line of the cooling water supply device leads to the chamber of the multi-chamber system which is connected with the appliance outlet, in contrast to the state of the art, explained at the beginning, teaching the cooling water supply into the chamber of the condenser, which is connected with the cooking space, directly. This is due to the fact that further testing performed in the context of the disclosure has yielded that by leading the supply line into this chamber the water supply can be controlled or rather regulated in a significantly more effective manner and therefore, on one hand, the compliance of the temperature limits of the wastewater discharged into the sewage system can be ensured and, on the other hand, the water consumption can be decreased by means of the enhanced capability of controlling or rather regulating compared to previous systems.

The water consumption is also advantageously influenced by the fact that in a condenser with a multi-chamber system the temperatures are decreasing from the chamber fluidly connected with the cooking space to the chamber comprising the appliance outlet, which would imply in the case of N chambers, for example:

$$T1>T2>T3>T4 \ldots >TN$$

The contents of the dependent claims provide advantageous further developments.

Especially, in a particularly preferred embodiment it is possible to introduce the supply line into the third chamber such that it protrudes into the orifice area of the appliance outlet. This is particularly advantageous in the case that wastewater from the first chamber of the condenser is fed directly into the appliance outlet through a wastewater pump, preferably provided with a venting function. As in this embodiment the cooling water supply line protrudes into this appliance outlet, it is possible to perform a pre-cooling of the appliance outlet and of the following sewage system by pumping cooling water into the appliance outlet prior to feeding wastewater, and furthermore in another, particularly preferred embodiment in this arrangement a mixing device, e.g. in form of a baffle plate, can be arranged in the appliance outlet. This mixing device enables to mix the supplied hot wastewater with the fed cooling water uniformly, facilitating and especially faster enabling the lowering towards the temperature limit to be complied.

In order to perfect the control or rather regulation of the cooling water supply further, it is possible to provide temperature sensors at different positions of the system. In particular, a temperature sensor can be provided in the appliance outlet, especially integrated in the mixing device. Furthermore, it is possible to provide temperature sensors in the first and/or third chamber.

In another, particularly preferred embodiment a temperature sensor can also be provided in the supply line of the cooling water supply device.

Because of this, it is enabled to calculate the quantity of water exactly using the principle of conservation of energy $M1\times T1\times(T1-TM)=M2\times T2\times(TM-T2)$, further perfecting the reduction of the cooling water consumption.

Furthermore, it is possible to provide the third chamber and/or the connecting piece with a thermal insulation to reduce an increased thermal input by thermal irradiation originating from the cooking space, for example. Here the chamber and/or the connecting piece can be made of a poorly heat-conducting material. As well, it is possible to provide a connecting piece or a chamber made in such a manner with a thermally insulating layer additionally.

In order to control or rather regulate the water consumption in an appropriate manner, the method according to the disclosure can define a sequential procedure setting a water cooling for a determined time period, whereupon the hot water supply can be activated. To this end, the cooking appliance according to the disclosure can be provided with a control/regulating device which, on one hand, receives signals from the temperature sensors or other sensors present in the system and, on the other hand, controls the components of the system to be controlled or rather regulated, such as for example different pumps, shut-off devices or valves, according to the received signals. Mainly, the sensors may be temperature sensors and, as explained above, the components to be controlled may be shut-off devices, valves, circulation pumps, wastewater pumps, the steam generator, the motor of the fan propeller and/or the heating device.

In an alternative embodiment, it is possible to adjust the water volume flows of cooling water and hot water using the previously explained temperature sensors according to the principle of conservation of energy.

Further details, advantages and features of the present disclosure result from the following description of embodiments on the basis of the drawings.

DETAILED DESCRIPTION OF THE PREFERRED EMBODIMENT

Figure 1:
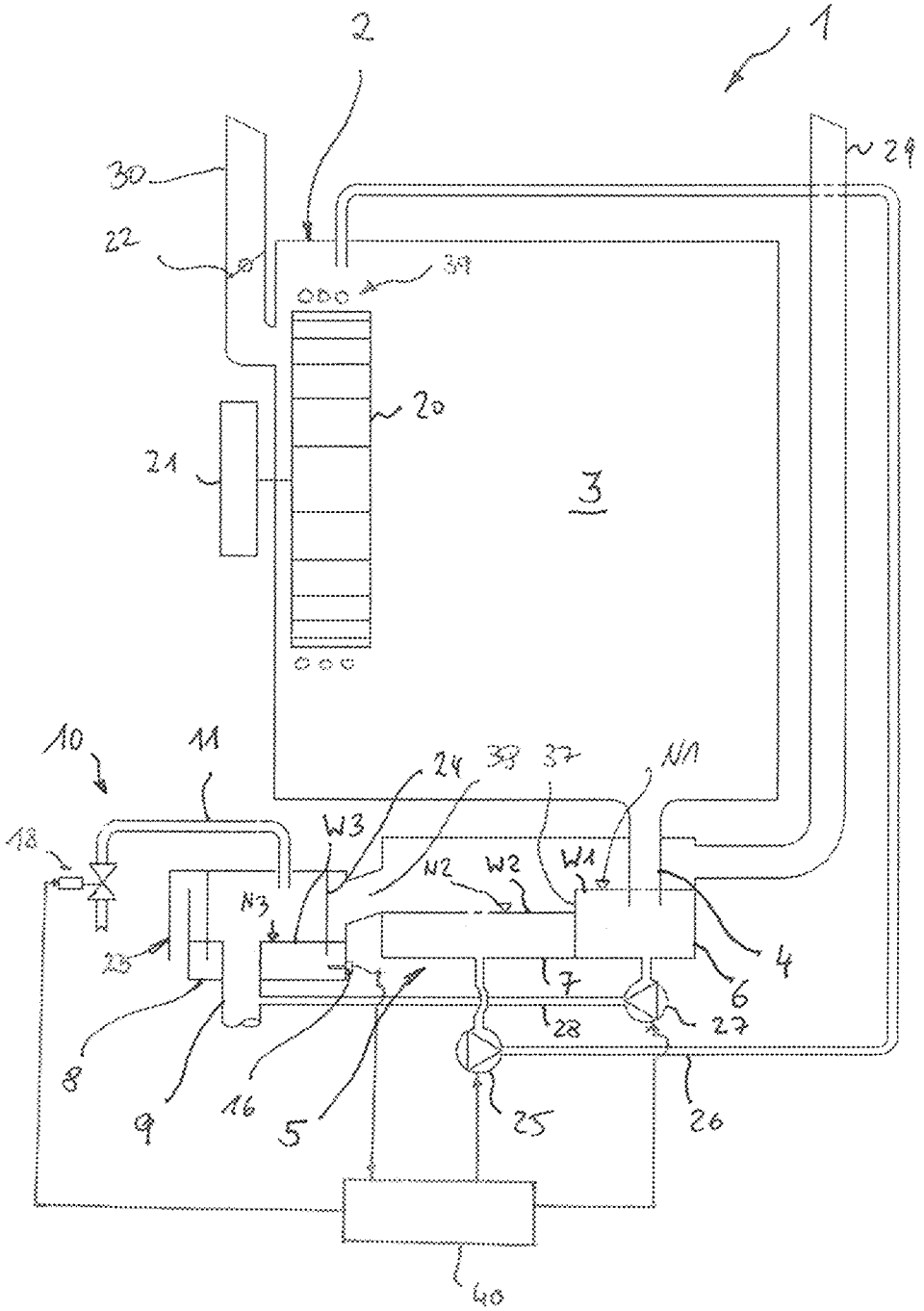
FIG. 1 shows a schematically simplified representation of a cooking appliance according to the disclosure corresponding to a first embodiment.

FIG. 1 shows a first embodiment of a cooking appliance 1 according to the disclosure. The cooking appliance 1 comprises a housing 2 in which a cooking space 3 is arranged. This cooking space 3 can be opened and closed by a cooking space door not depicted in the figure in detail. The cooking space 3 is provided with a housing outlet 4 configured as an outlet pipe leading into a first chamber 6 of a condenser 5.

As FIG. 1 illustrates, a fan propeller 20 configured to be set into rotation by a motor 21 is arranged in the cooking space 3.

Behind the fan propeller 20 a fresh air supply pipe 30, in which a dehumidifier flap 22 is arranged, leads into the cooking space 3.

The condenser 5 is configured as a condenser with a multi-chamber system which is a three-chamber system in the illustrated exemplary case. Correspondingly, in the illustrated exemplary case the condenser 5 comprises a first chamber 6 including a first water trap W1 with a level N1 and a second chamber 7 which follows the first chamber 6 and is separated from the first chamber 6 by means of an overflow, e.g. an overflow plate 37, but is also fluidly connected therewith.

The second chamber 7 has a second water trap W2 with a level N2 and is fluidly connected with a third chamber 8 through a connecting piece 38.

The third chamber 8 has a third water trap W3 with a level N3 and is fluidly connected with an odour trap 24.

Furthermore, an appliance outlet 9, e.g. in form of an outlet pipe, protrudes into the third chamber 8 up to the height of the level N3. Finally, the third chamber 8 comprises a security overflow 23.

The first chamber 6 is fluidly connected with the appliance outlet 9 through a wastewater line 28 in which a wastewater pump 27, preferably comprising a dehumidifying function, is arranged.

The second chamber 7 is fluidly connected with the cooking space 3 through a circulation line 26 in which a circulation pump 25 is arranged.

The third chamber 8 is further provided with a temperature sensor 16.

As an additional component, the cooking appliance according to the disclosure corresponding to the embodiment of FIG. 1 has a cooling water supply device 10, for example comprising a supply line 11, leading into the third chamber 8 above the level N3 in the exemplary case. In the supply line 11 a shut-off device, preferably in form of a valve 18, is provided by means of which the supply of cooling water through the supply line 11 can be controlled or rather regulated.

Figure 2:
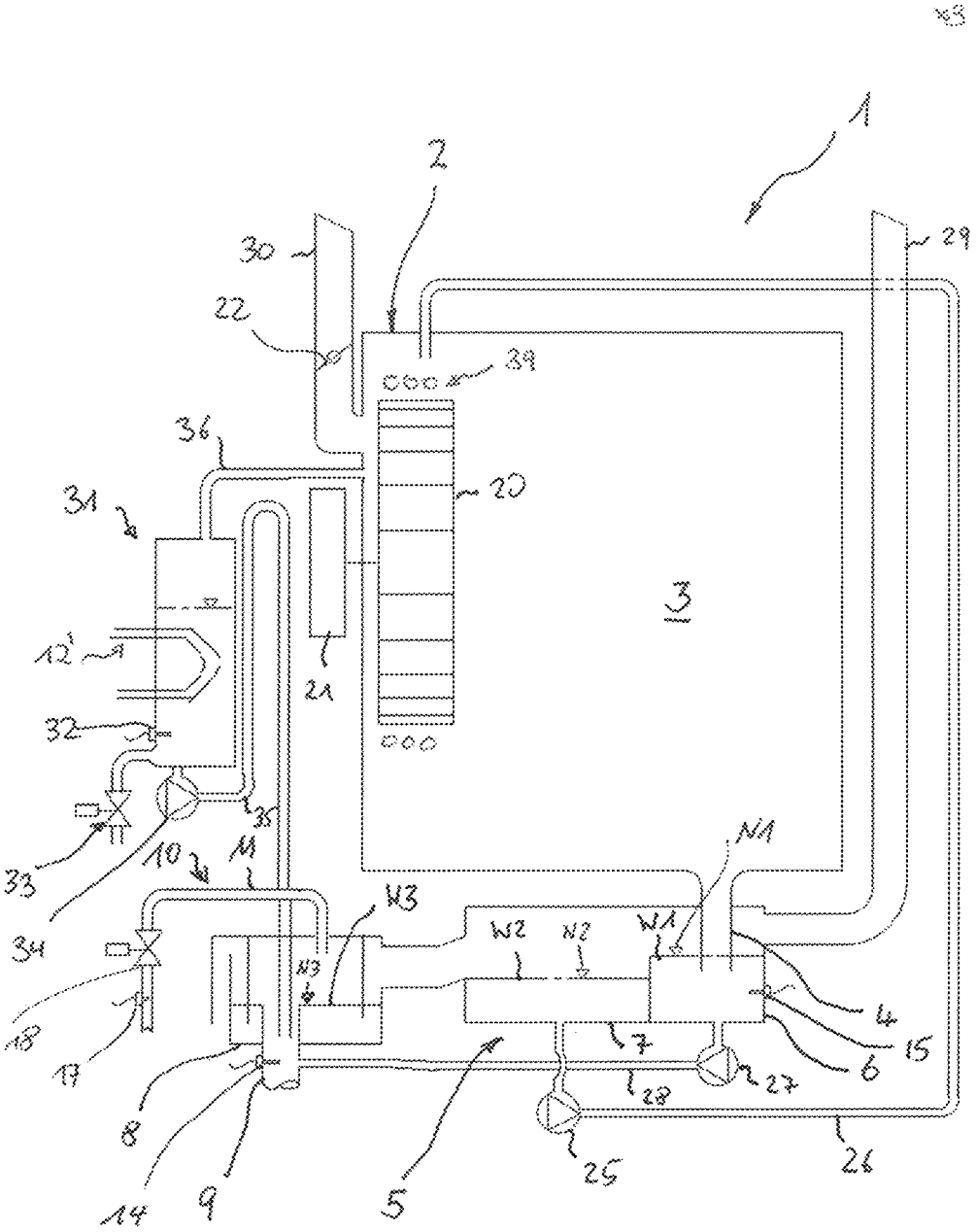
FIG. 2 shows a representation of a second embodiment corresponding to FIG. 1.

In FIG. 2 a second embodiment of the cooking appliance 1 according to the disclosure is shown, wherein all components structurally and functionally corresponding to those of FIG. 1 are denoted by the same reference numbers. Insofar, the preceding description of FIG. 1 can be referred to. The embodiment of the cooking appliance 1 further comprises a steam generator 31 fluidly connected with the cooking space 3 through a steam line 36.

In addition, the steam generator 31 has a shut-off device for the water supply configured to be opened and closed, which can be configured as a valve 33, for example.

In addition, the steam generator 31 is fluidly connected with the third chamber 8 through a draining line 35 in which a pump 34 is arranged, wherein the draining line 35 herein leads into the appliance outlet 9. Thus, particles from the steam generator can directly be conveyed into the appliance outlet 9.

In this embodiment the first chamber 6 is provided with a temperature sensor 15, wherein a temperature sensor 17 in the supply line 11 and a temperature sensor 14 in the appliance outlet 9 are also provided.

If it is intended in the embodiments according to FIGS. 1 and 2 to feed wastewater into a sewage system, cooling water is fed into the third chamber 8 through the cooling water supply device 10 depending on the quantity and the temperature of the heated wastewater to be discharged, wherein it is possible for example to feed cooling water into the third chamber 8 prior to the supply of wastewater through the wastewater line 28, in order to pre-cool the appliance outlet 9 and to be able to feed the heated wastewater into the cooling water flow for enabling the desired lowering of the temperature in a secure way.

Figure 3:
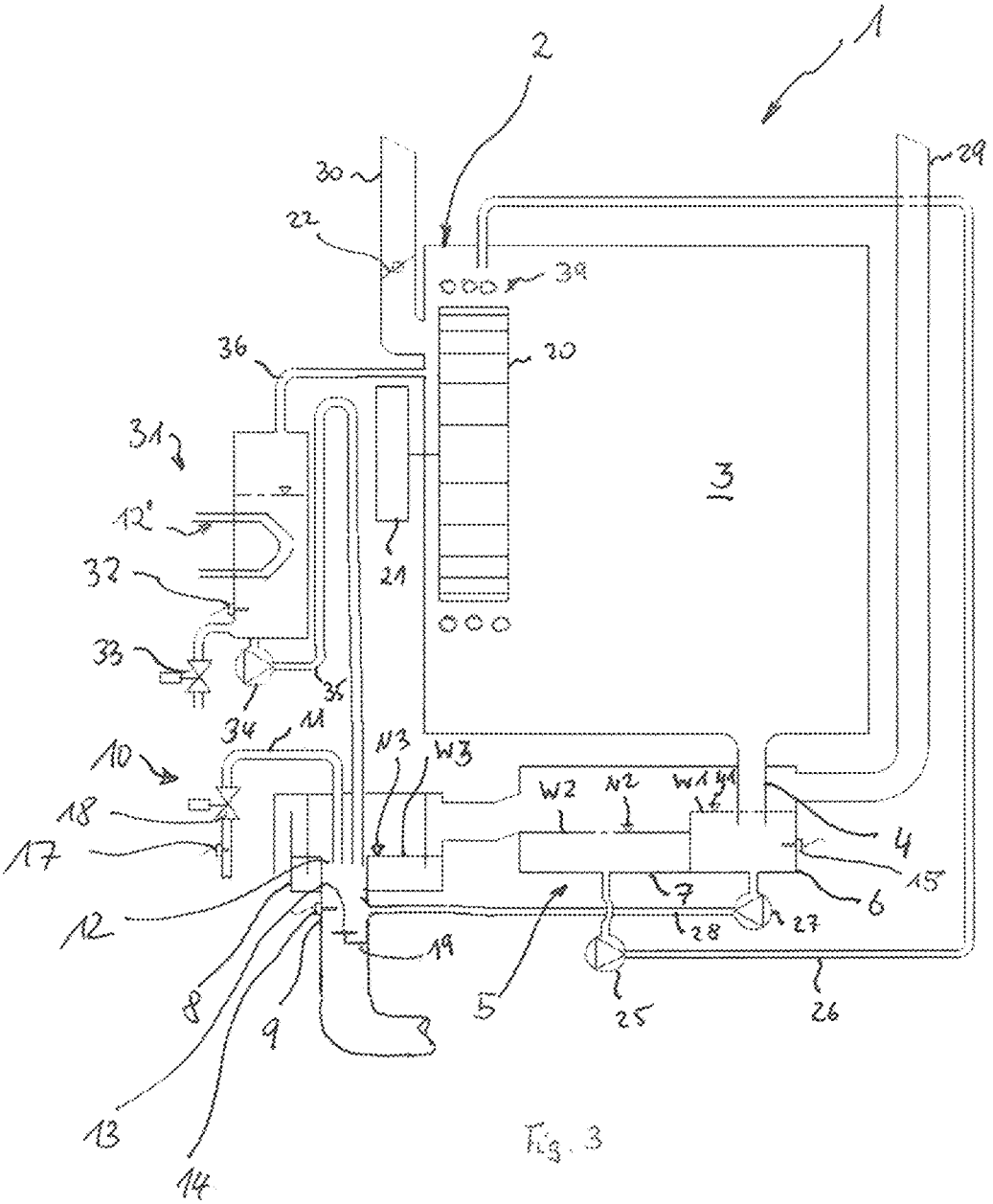
FIG. 3 shows a third embodiment corresponding to one of FIGS. 1 and 2.

The third embodiment of the cooking appliance 1 of FIG. 3 according to the disclosure substantially corresponds to the embodiment of FIG. 2, wherein in turn all components in FIG. 3 structurally and functionally corresponding to each other are denoted by the same reference numbers as in FIG. 2. Insofar, the description of FIG. 2 can be referred to.

In the embodiment of FIG. 3 however, it is provided that the supply line 11 protrudes into an orifice area 12 of the appliance outlet 9, that means at least to approximately the height of the level N3. Furthermore, the supply line 11 can be provided with a nozzle configured to inject the cooling water into the appliance outlet 9 directly. Hereby, the supply line 11 can end above the orifice area 12 in the third chamber 8.

In addition, in this embodiment a mixing device 13 is provided as a particularly preferred feature which is arranged in the appliance outlet 9 beneath the introduction point of the wastewater line 28. For example, this mixing device 13 can be configured as a baffle plate fixable in the appliance outlet 9 by means of an appropriate fastening device 19. The temperature sensor 14 provided in the appliance outlet 9 can alternatively be arranged at the mixing device or rather the baffle plate 13. The cooking appliance 1 of the embodiment according to FIG. 3 is further provided with a temperature sensor 32 mounted at the steam generator 31.

If it is intended to feed hot water from the steam generator 31 and/or the wastewater line 28 into the appliance outlet 9, in this embodiment it is preferably possible to pre-cool the appliance outlet 9 prior to the feed of hot water into it as the supply line 11 introduces cooling water into the third chamber and so into the appliance outlet 9. Thereupon, it is possible to feed hot water from the steam generator 31 and/or the wastewater line 28 into the appliance outlet 9, wherein the mixing device 13 further enhances the mixture of hot water and cooling water which additionally perfects the lowering towards the temperature limit to be complied and especially reduces the lowering time.

In case that the temperature in the first chamber 6 is very high and the cooling water to be fed into is relatively warm, the pump 27 and/or 34 can correspondingly be timed for a sufficient cooling of the wastewater to be discharged to adapt the water volume flows of the wastewater to be cooled and of the cooling water such that according to the principle of conservation of energy the water temperature of the water to be discharged does not exceed the legal limits.

As explained at the beginning, therefore a control/regulating device can be provided which is symbolized by the block 40 in FIG. 1, representative for all embodiments according to FIG. 1, 2 or 3. This control/regulating device 40 can be arranged in signal connection with all sensors provided in the system, as in the exemplary case of FIG. 1 with the sensor 16, and control or rather regulate the corresponding components to be controlled or rather regulated, as in the exemplary case the pumps 25, 27 as well as the shut-off device 18.

Additionally, it has to be emphasized that in the shown exemplary cases the water traps W1, W2 and W3 have different levels each. However, it is also possible that the levels of the three water traps W1, W2 and W3 have the same height.

Furthermore, the used term "cooking appliance, in particular commercial cooking appliance" should be understood as including any type of food treatment appliances. Accordingly, these can be cooking appliances operated with hot air and/or steam (combi steamers), grills, microwave ovens and common electric cookers as well as coffeemakers, beverage dispensers and/or ice makers.

Besides the preceding written disclosure of the disclosure, hereby supplementing the disclosure, explicit reference shall be made to the graphic representation of the disclosure in FIGS. 1 to 3.

LIST OF REFERENCE SIGNS

1 Cooking appliance
2 Housing
3 Cooking space
4 Housing outlet/cooking space outlet
5 Condenser
6 First chamber
7 Second chamber
8 Third chamber
9 Appliance outlet
10 Cooling water supply device
11 Supply line
12 Orifice area
12' Heating device
13 Mixing device/baffle plate
14, 15, 16, 17, 32 Temperature sensor
18 Shut-off device/valve
19 Holding device
20 Fan propeller
21 Motor
22 Dehumidifier flap
23 Security overflow
24 Odour trap
25 Circulation pump
26 Circulation line
27 Wastewater pump, preferably with dehumidifying function
28 Wastewater line
29 Exhaust air pipe
30 Fresh air pipe
31 Steam generator
33 Shut-off device, configured to be opened and closed
34 Pump
35 Draining line
36 Steam line
37 Overflow
38 Connecting piece
39 Heating device of the cooking space 3
40 Control/regulating device
W1-W3 Water traps
N1-N3 Height/level of the water traps W1 to W3

The invention claimed is:

1. A cooking appliance comprising:

a housing having a cooking space and an outlet from the cooking space, an appliance outlet, a condenser fluidly connected to the cooking space, wherein the condenser comprises a first, a second and a third separate chamber each fluidly connected to another of the separate chambers, wherein the outlet from the cooking space is disposed in the first of the plurality of separate chambers, wherein the appliance outlet is disposed in the third of the plurality of separate chambers, and wherein the second of the plurality of separate chambers is disposed between the first and the third separate chambers, a cooling water supply device, wherein the cooling water supply device has at least one supply line having an end disposed in the third of the plurality of separate chambers, wherein the end of the supply line is disposed in an air space at a location selected from above a water level in the third of the plurality of chamber, an orifice area of the appliance outlet, or a combination of the foregoing.

2. The cooking appliance according to claim 1, further comprising a mixing device disposed in the appliance outlet.

3. The cooking appliance according to claim 2, wherein the appliance outlet is provided with a temperature sensor.

4. The cooking appliance according to claim 3, wherein the temperature sensor is disposed at the mixing device.

5. The cooking appliance according to claim 1, wherein the supply line is provided with a temperature sensor.

6. The cooking appliance according to claim 1, wherein the supply line is provided with a shut-off device configured to be opened and closed.

7. The cooking appliance according to claim 1, wherein the cooling water supply device is configured to be controlled or regulated by at least one temperature sensor.

8. A cooking appliance comprising:

a housing having a cooking space and an outlet from the cooking space;

a cooling water supply; and a condenser fluidly connected to the cooking space, wherein the condenser comprises three separate chambers, in sequence:

a first chamber, wherein the outlet from the cooking space is disposed in the first chamber and forms a first water trap, a second chamber fluidly connected to the first chamber and having a second water trap, and a third chamber fluidly connected to the second chamber and having a third water trap defined by the position of the third chamber, wherein the second chamber is disposed between the first and the third chamber, wherein the third chamber is connected with an appliance wastewater outlet, and wherein the cooling water supply has at least one supply line having an end disposed in the third chamber, wherein the end of the supply line is disposed in an air space at a location selected from above a water level in the third of the plurality of chamber, an orifice area of the appliance outlet, or a combination of the foregoing.

9. The cooking appliance according to claim 8, wherein the first chamber is provided with a temperature sensor.

10. The cooking appliance according to claim 8, wherein the third chamber is provided with a temperature sensor.

11. The cooking appliance according to claim 8, wherein the third chamber is thermally insulated.

12. The cooking appliance according to claim 8, wherein the third chamber or the fluid connection between the third chamber and the second chamber is thermally insulated.

* * * * *